US009939766B2

(12) United States Patent
Monde et al.

(10) Patent No.: US 9,939,766 B2
(45) Date of Patent: Apr. 10, 2018

(54) IMAGE FORMING APPARATUS AND RECORDING MATERIAL DETERMINATION APPARATUS

(71) Applicant: CANON KABUSHIKI KAISHA, Tokyo (JP)

(72) Inventors: Masafumi Monde, Kawasaki (JP); Tomohiro Hashimoto, Numazu (JP); Tsutomu Ishida, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/334,132

(22) Filed: Oct. 25, 2016

(65) Prior Publication Data

US 2017/0123359 A1 May 4, 2017

(30) Foreign Application Priority Data

Oct. 30, 2015 (JP) ..... 2015-214973

(51) Int. Cl.
*G03G 15/00* (2006.01)

(52) U.S. Cl.
CPC ..... *G03G 15/5062* (2013.01); *G03G 15/5029* (2013.01); *G03G 15/6591* (2013.01); *G03G 15/6594* (2013.01); *G03G 2215/00738* (2013.01); *G03G 2215/00742* (2013.01)

(58) Field of Classification Search
CPC ..... G03G 15/5029; G03G 15/5062
USPC ..... 399/45
See application file for complete search history.

(56) References Cited

U.S. PATENT DOCUMENTS 6,002,429 A * 12/1999 Ochi ..... H04N 1/00127 348/220.1
2013/0148990 A1* 6/2013 Kuramochi ..... B65H 7/02 399/45

FOREIGN PATENT DOCUMENTS

| | | | |
|---|---|---|---|
| JP | 2006-162963 A | | 6/2006 |
| JP | 2006-292952 A | | 10/2006 |
| JP | 2008020262 A | * | 1/2008 |
| JP | 2009-029622 A | | 2/2009 |
| JP | 2015-194609 A | | 11/2015 |

OTHER PUBLICATIONS

JP 2008-020262: English translation of Description.*

* cited by examiner

*Primary Examiner* — Walter L Lindsay, Jr.
*Assistant Examiner* — Arlene Heredia Ocasio
(74) *Attorney, Agent, or Firm* — Canon USA, Inc., IP Division

(57) ABSTRACT

An image forming apparatus includes an image formation unit configured to form an image on a recording material, a conveyance unit configured to convey a recording material, an irradiation unit configured to emit light onto the recording material being conveyed by the conveyance unit, an image capturing unit configured to capture the light emitted by the irradiation unit and reflected from the recording material as a surface image of the recording material, and a control unit configured to control an image forming condition of the image formation unit based on the surface image of the recording material acquired by the image capturing unit, wherein the control unit controls the image forming condition based on a plurality of surface images of the recording material having different resolutions.

11 Claims, 12 Drawing Sheets

BLOCK DIAGRAM OF SURFACE PROPERTY DETECTION UNIT

ARRANGEMENT DIAGRAM OF LIGHT RECEIVING ELEMENTS IN IMAGE-CAPTURING UNIT 32c

CIRCUIT DIAGRAM OF LIGHT RECEIVING ELEMENT IN IMAGE-CAPTURING UNIT 32c

PLAIN PAPER

BOND PAPER

FIG.4

| SHEET TYPE | DIFFERENCE VALUE BETWEEN FEATURE QUANTITIES [dec] |
|---|---|
| PLAIN PAPER | LESS THAN 30 |
| BOND PAPER | EQUAL TO OR GREATER THAN 30 |

IMAGE OF FIRST RESOLUTION

IMAGE OF SECOND RESOLUTION

FIG.10

| SHEET TYPE | GRAMMAGE DETECTION VALUE [g/m$^2$] | DIFFERENCE VALUE BETWEEN FEATURE QUANTITIES [dec] |
|---|---|---|
| THIN PAPER | LESS THAN 70 | LESS THAN 20 |
| THIN BOND PAPER | | EQUAL TO OR GREATER THAN 20 |
| PLAIN PAPER | EQUAL TO OR GREATER THAN 70 | LESS THAN 30 |
| BOND PAPER | | EQUAL TO OR GREATER THAN 30 |

BLOCK DIAGRAM OF SURFACE PROPERTY DETECTION UNIT

IMAGE FORMING APPARATUS AND RECORDING MATERIAL DETERMINATION APPARATUS

BACKGROUND OF THE DISCLOSURE

Field of the Disclosure

The present disclosure relates to a technique for accurately determining a type of a recording material and controlling an image forming condition according to the determination result.

Description of the Related Art

Conventionally, there has been an image forming apparatus such as a copying machine or a printer including a sensor for determining a type of a recording material. Such an image forming apparatus automatically determines a type of a recording material and controls a transfer condition (e.g., a transfer voltage or a conveyance speed of a recording material in a transfer period) or a fixing condition (e.g., a fixing temperature or a conveyance speed of a recording material in a fixing period) according to the determination result.

Japanese Patent Application Laid-Open No. 2009-029622 discusses an image forming apparatus including a recording material determination unit that determines a type of a recording material by emitting light to the recording material and capturing the light reflected on the recording material as an image through a complementary metal oxide semiconductor (CMOS) sensor. In this image forming apparatus, a transfer voltage, a fixing temperature, and a conveyance speed of the recording material are controlled according to the type of the recording material determined by the recording material determination unit. With this configuration, an image of high quality can be formed on the recording material.

However, because of an influence of production variation arising in recording materials, similar detection results may be acquired, as detection results of the sensor, from the recording materials of different types. In such a case, as it is difficult to accurately determine a type of the recording material, the recording material may be erroneously determined as a recording material of a different type, and an image is formed under the image forming condition not suitable for the recording material of that type. Thus, this may result in degradation in the image quality. Although the control method described in Japanese Patent Application Laid-Open No. 2009-029622 has sufficiently realized the image quality desired in those days, it is desirable to further improve the accuracy for determining the type of the recording material in order to realize the image quality required in these days.

SUMMARY OF THE DISCLOSURE

One aspect of the present disclosure is directed to an image forming apparatus capable of forming an image of high quality by accurately determining a type of a recording material.

According to an aspect of the present disclosure, an image forming apparatus includes an image formation unit configured to form an image on a recording material, a conveyance unit configured to convey a recording material, an irradiation unit configured to emit light onto the recording material conveyed by the conveyance unit, an image capturing unit configured to capture the light emitted by the irradiation unit and reflected from the recording material as a surface image of the recording material, and a control unit configured to control an image forming condition of the image formation unit based on the surface image of the recording material acquired by the image capturing unit, wherein the control unit controls the image forming condition based on a plurality of surface images or the recording material having different resolutions.

Further features of the present disclosure will become apparent. from the following description of exemplary embodiments with reference to the attached drawings.

BRIEF DESCRIPTION OF THE DRAWINGS

FIG. 4 is a determination table of types of recording sheets according to the first and the second exemplary embodiments.

FIG. 10 is a determination table of types of recording sheets according to the third exemplary embodiment.

DESCRIPTION OF THE EMBODIMENTS

Hereinafter, an exemplary embodiment will be described with reference to the appended drawings.

<Description of Image Forming Apparatus>

Figure 1:
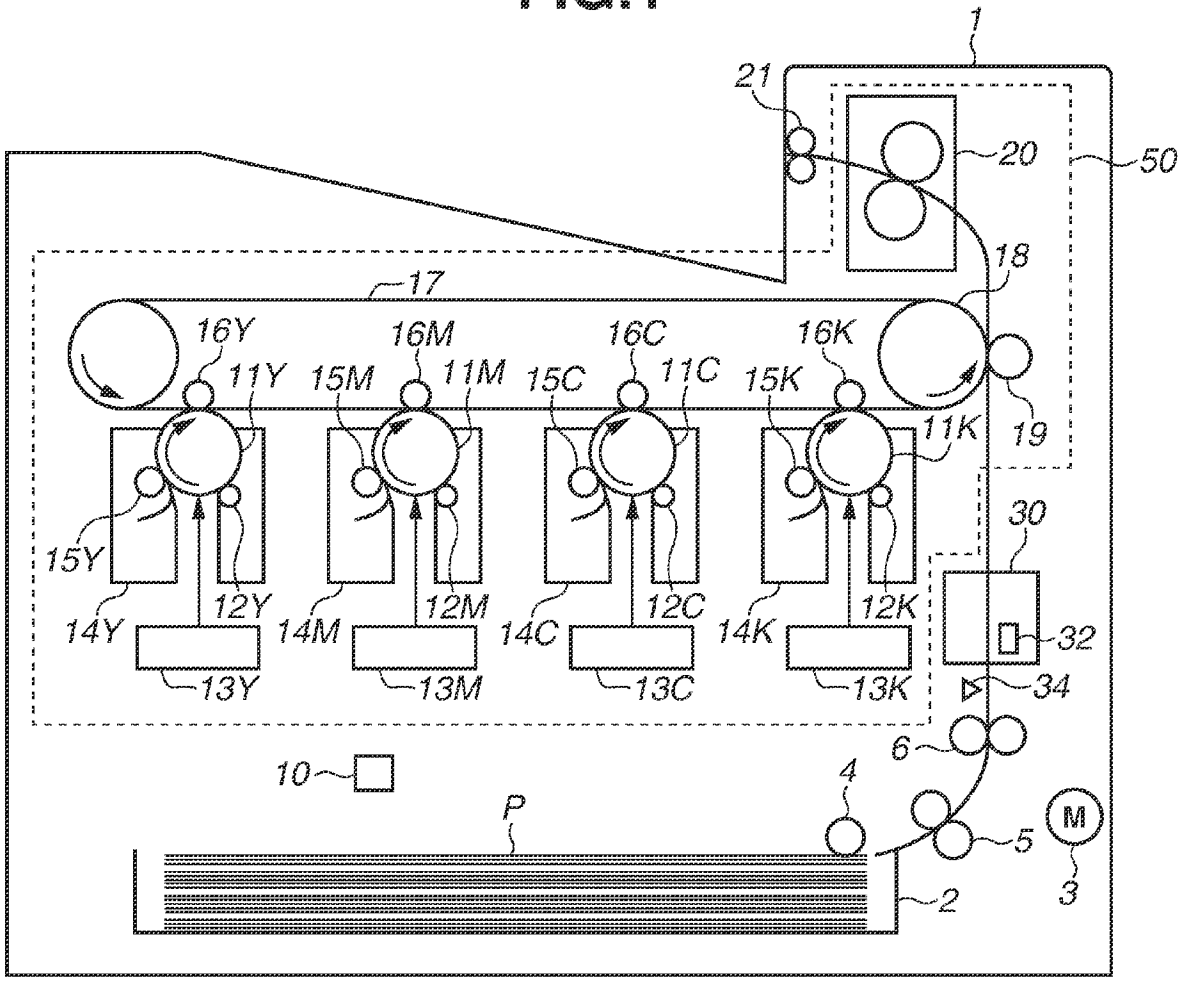
FIG. 1 is a diagram illustrating a configuration of an image forming apparatus according to a first and a second exemplary embodiments.

Hereinafter, a first exemplary embodiment will be described. In the present exemplary embodiment, an electrophotographic type color laser beam printer 1 (hereinafter, referred to as "printer 1") will be described as an image forming apparatus. FIG. 1 is a diagram schematically illustrating a configuration of the printer 1.

The printer 1 is a tandem-type color printer capable of forming a color image on a recording sheet P (recording material) by superimposing toner in four colors of yellow (Y), magenta (M), cyan (C), and black (K) serving as developer. A cassette 2 is a container for storing the recording sheet P. A feeding roller 4 that feeds the recording sheet P from the cassette 2, and a conveyance roller pair 5 and a registration roller pair 6 that convey the fed recording sheet P are arranged on a conveyance path of the recording sheet P. A registration sensor 34 for detecting the recording sheet P is arranged in a vicinity of the registration roller pair 6. The registration sensor 34 detects a leading end (i.e., an end portion on a downstream side in a conveyance direction of the recording sheet P) and a trailing end (i.e., an end portion on an upstream side in the conveyance direction of the recording sheet P) of the recording sheet P.

A photosensitive drum 11 (11Y, 11M, 11C, and 11K, hereinafter collectively referred to as the photosensitive drum 11) carries toner. A charging roller 12 (12Y, 12M, 12C, and 12K, hereinafter collectively referred to as the charging roller 12) uniformly charges the photosensitive drum 11 in a predetermined potential. A laser scanner 13 (13Y, 13M, 13C, and 13K, hereinafter collectively referred to as the scanner 13) forms an electrostatic latent image on the photosensitive drum 11 by exposing the charged photosensitive drum 11 to light. A process cartridge 14 (14Y, 14M, 14C, and 14K, hereinafter collectively referred to as the process cartridge 14) stores toner used for visualizing the electrostatic latent image formed on the photosensitive drum 11. A development roller 15 (15Y, 15M, 15C, and 15K, hereinafter collectively referred to as the development roller 15) forms a toner image on the photosensitive drum 11 by feeding the toner stored in the process cartridge 14 to the photosensitive drum 11.

A primary transfer roller 16 (16Y, 16M, 16C, or 16K, hereinafter collectively referred to as the primary transfer roller 16) primarily transfers the toner image formed on the photosensitive drum. 11 onto an intermediate transfer belt 17. The intermediate transfer belt 17 is rotated by a driving roller 18 in a direction indicated by an arrow in FIG. 1. A secondary transfer roller 19 (transfer unit) transfers the image formed on the intermediate transfer belt 17 onto the recording sheet P. A fixing unit 20 (fixing unit) melts the toner image secondarily transferred onto the recording sheet P and fixes the toner image thereto while conveying the recording sheet P. An image formation unit 50 for forming an image on the recording sheet P is configured of the respective units of the photosensitive drum 11 to the fixing unit 20 described above. A discharge roller 21 discharges the recording sheet P on which the image is fixed by the fixing unit 20.

A pulse motor 3 drives the registration roller pair 6 serving as a conveyance unit. Although the other rollers are driven by a plurality of driving sources (not illustrated), the configuration is not limited thereto, and any configuration may be employed as long as the recording sheet P can be conveyed through a desired operation. For example, the conveyance roller pair 5 may be also driven by the pulse motor 3 in addition to the registration roller pair 6.

A recording material detection unit 30 (hereinafter, referred to as "detection unit 30") detects a property of the recording sheet P in order to determine the type of the recording sheet P. The detection unit 30 is configured of a surface property detection unit 32 for detecting a surface property of the recording sheet P as a property of the recording sheet P. The surface property detection unit 32 is configured of an irradiation unit 32*a*, an image focusing unit 32*b*, and an image capturing unit 32*c* described below, so as to detect a surface property (concavo-convex state) of the recording sheet P.

A control unit 10 controls an operation of the printer 1. The control unit 10 includes a central processing unit (CPU), a random access memory (RAM) used for calculating and temporality storing data necessary for controlling the printer 1, and a read only memory (ROM) for storing programs and various types of data for controlling the printer 1, although they are not illustrated. A function of the control unit 10 will be described below in detail.

<Description of Recording Material Detection Unit>

Next, an operation overview of the surface property detection unit 32 that constitutes the detection unit 30 will be described with reference to FIGS. 2A, 2B, and 2C.

Figure 2A:
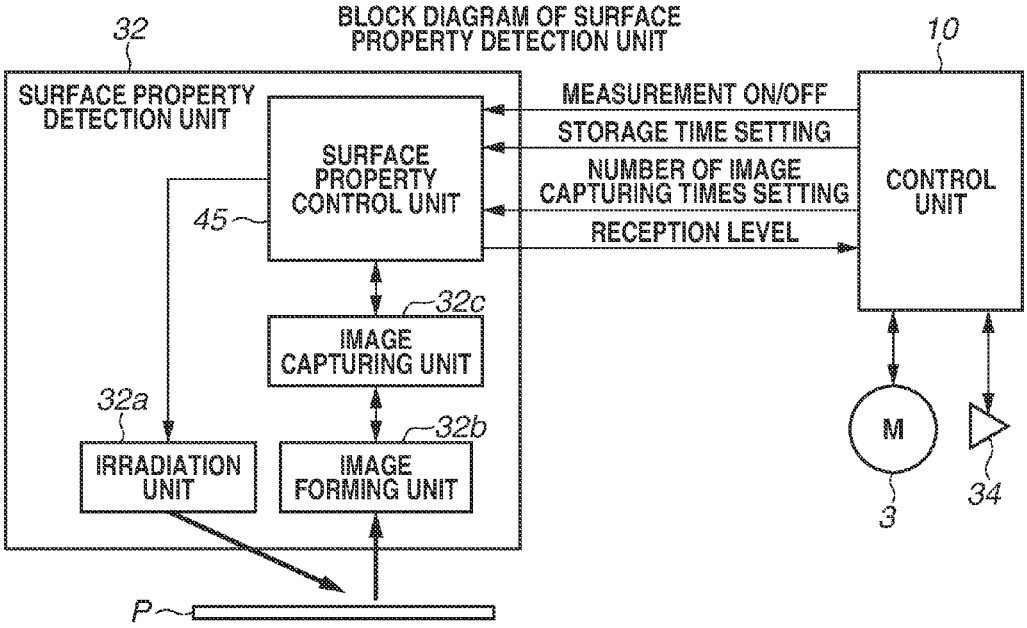
FIGS. 2A, 2B, and 2C are a block diagram of a surface property detection unit, an arrangement diagram of a light receiving element, and a circuit diagram of the light receiving element, respectively.

FIG. 2A is a block diagram of the surface property detection unit 32. The surface property detection unit 32 is configured of the irradiation unit 32*a*, the image focusing unit 32*b*, and the image capturing unit 32*c*. The irradiation unit 32*a* emits light to the surface of the recording sheet P. The image focusing unit 32*b* forms the light emitted from the irradiation unit 32*a* and reflected on the surface of the recording sheet P into an image on the image capturing unit 32*c*. The image capturing unit 32*c* captures the light formed into the image by the image focusing unit 32*b* as a surface image.

Figure 2B:
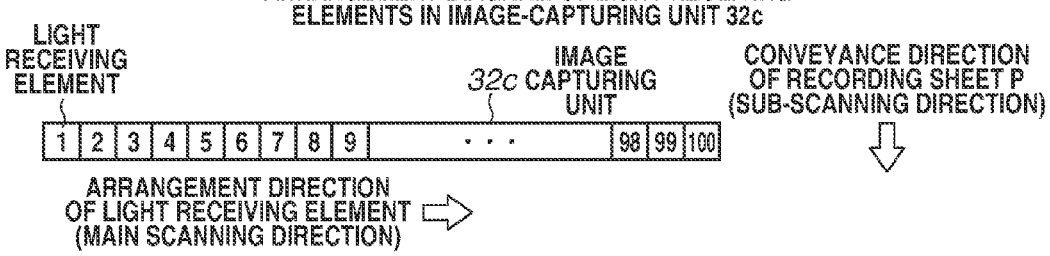
Figure 2C:
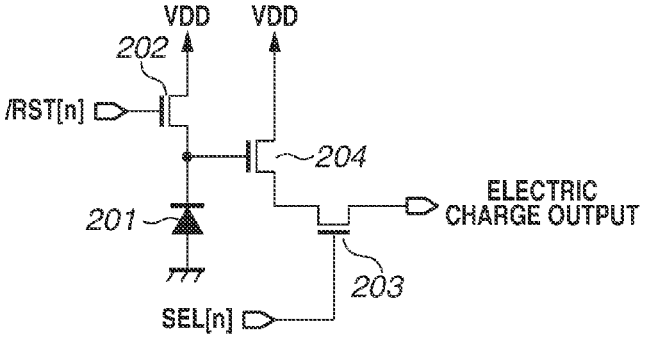

In the present exemplary embodiment, the image capturing unit 32*c* is a complementary metal oxide semiconductor (CMOS) line sensor in which 100 pieces of light receiving elements for receiving light are arranged as illustrated in FIG. 2B. Herein, one light receiving element corresponds to one pixel. In other words, a surface image of 100-pixel worth can be acquired through a single image-capturing operation executed by the CMOS line sensor. The plurality of light receiving elements is arranged in a direction that is parallel to a surface of the recording sheet P and orthogonal to the conveyance direction of the recording sheet P (hereinafter, referred to as "main scanning direction").

An operation of the light receiving element which constitutes the image capturing unit 32*c* will be described with reference to a typical circuit of the CMOS line sensor illustrated in FIG. 2C. The light receiving element is configured of a photodiode 201, a reset metal oxide semiconductor (MOS) transistor 202, a selection MOS transistor 203, and an amplification MOS transistor 204. The electric charge of the photodiode 201 stored through photoelectric conversion is output to a surface property control unit 45 as an electric charge output signal through the amplification MOS transistor 204 serving as an amplifier and the selection MOS transistor 203.

Herein, an electric charge output signal line of each light receiving element is connected as a common line, and an electric charge output of each light receiving element is sequentially output to the electric charge output signal line when the selection MOS transistor 203 of each light receiving element is controlled. For example, an "electronic shutter control method" is provided as a control method of the light receiving element. First, the electric charge of each photodiode 201 is reset by the reset MOS transistor 202. Then, when the reset is released by the reset MOS transistor 202, the electric charge of the photodiode 201 is stored by a signal charge generated through photoelectric conversion. After a predetermined time (storage time) has elapsed from the time at which the reset is released, the electric charge of the light receiving element is output as the electric charge output signal via the amplification MOS transistor 204 and the selection MOS transistor 203. The electric charge of the photodiode 201 of the pixel from which the electric charge has been read is reset again by the reset MOS transistor 202. As described above, the storage time of the electric charge of the photodiode 201 can be controlled by the operation timings of the reset MOS transistor 202 and the selection MOS transistor 203.

Further, the surface property detection unit 32 can acquire the surface image of a size corresponding to "number of image-capturing times×100 pixels" when series of image-capturing operations repeatedly executed while the recording sheet P is conveyed, and the line-like captured surface images are connected in the conveyance direction of the recording sheet P (referred to as "sub-scanning direction").

The surface property control unit 45 controls the irradiation unit 32*a* and the image capturing unit 32*c* according to a measurement on/off signal, a storage time setting signal, and a number-of-image-capturing-times setting signal transmitted from the control unit 10. According to the above signals, the surface property control unit 45 generates timing signals of the reset MOS transistor 202 and the selection MOS transistor 203 in the light receiving element of the image capturing unit 32*c*. With this operation, the surface property control unit 45 controls the image-capturing start timing of the image capturing unit 32*c*, the electric charge storage time of the photodiode 201, and the number of image-capturing times. Further, for example, with respect to the electric charge output signal received from the image capturing unit 32*c*, the surface property control unit 45 outputs a reception level signal to the control unit 10 through a noise cancel circuit (not illustrated) such as a correlated double sampling circuit.

The control unit 10 controls the rotation speed of the registration roller pair 6 through the pulse motor 3 to control the conveyance speed of the recording sheet P. As illustrated in FIG. 1, the registration sensor 34 is arranged in a position between the registration roller pair 6 and the detection unit 30, so that the control unit 10 can determine whether the recording sheet P has reached the position where the registration sensor 34 is arranged. The registration sensor 34 is an optical sensor that detects presence or absence of the recording sheet P by detecting whether light is shielded by the recording sheet P. The registration sensor 34 is not limited to the optical sensor, and any sensor capable of detecting presence or absence of the recording sheet P may be used therefor. The control unit 10 notifies the surface property control unit 45 of a measurement on/off signal according to a timing at which the control unit 10 determines that the recording sheet P has reached the position where the registration sensor 34 is arranged.

Further, the control unit 10 receives the reception level signal from the surface property control unit 45 through an analog/digital (AD) port of the CPU (not illustrated). The AD port can detect an input voltage at a resolution of 256 division levels by using a power-supply voltage as a reference, and the control unit 10 executes the AD conversion to convert the reception level signal into a dec value (output value) by detecting how many times the voltage input to the AD port is greater than the resolution. After executing the AD conversion of the reception level signal, the control unit 10 calculates a feature quantity indicating the surface property of the recording sheet P from the output value of each pixel.

In the present exemplary embodiment, a vertical difference integrated value will be acquired although various method can be considered as a calculation method of the feature quantity. In order to acquire the vertical difference integrated value, at first, an absolute value of a difference between output values of two pixels consecutively arranged in the sub-scanning direction is calculated, and one-row worth of the calculated values are integrated. Then, the vertical difference integrated value can be acquired by further integrating the acquired integrated values of respective rows. The recording sheet P having a smooth surface such as a coat paper has a vertical difference integrated value less than a predetermined threshold value, whereas the recording sheet P having a rough surface such as a bond paper has a vertical difference integrated value greater than the predetermined threshold value. By acquiring the vertical difference integrated value, the control unit 10 can determine the type (surface property) of the recording sheet P.

The control unit 10 controls the image forming condition of the image formation unit 50 based on the type (surface property) of the recording sheet P determined through. the above-described method. For example, because the coat paper has a resistance value lower than that of the bond paper, it is necessary to set a transfer voltage for transferring a toner image to be higher. Further, because the coat paper needs a lower temperature and a shorter time for fixing a toner image in comparison to the case of the bond paper, a fixing condition such as a fixing temperature or a conveyance speed of the recording sheet P has to be changed. As described above, a quality of the image formed on the recording sheet P can be improved by controlling the various image forming conditions.

Further, for example, a conveyance speed of the recording sheet P, a voltage value applied to the primary transfer roller 16 or the secondary transfer roller 19, and a temperature at which the image is fixed to the recording sheet P by the fixing unit 20 may be considered as other image forming conditions. Further, the control unit 10 may control a rotation speed of the primary transfer roller 16 or the secondary transfer roller 19 in the image transfer period as the image forming condition. Further, the control unit 10 may control a rotation speed of a fixing roller included in the fixing unit 20 in the image fixing period as the image forming condition. Furthermore, the control unit 10 may directly control the image forming condition based on the calculated value of the feature quantity without determining the type of the recording sheet P.

<Description of Determination Method of Type of Recording Material>

Figure 3A:
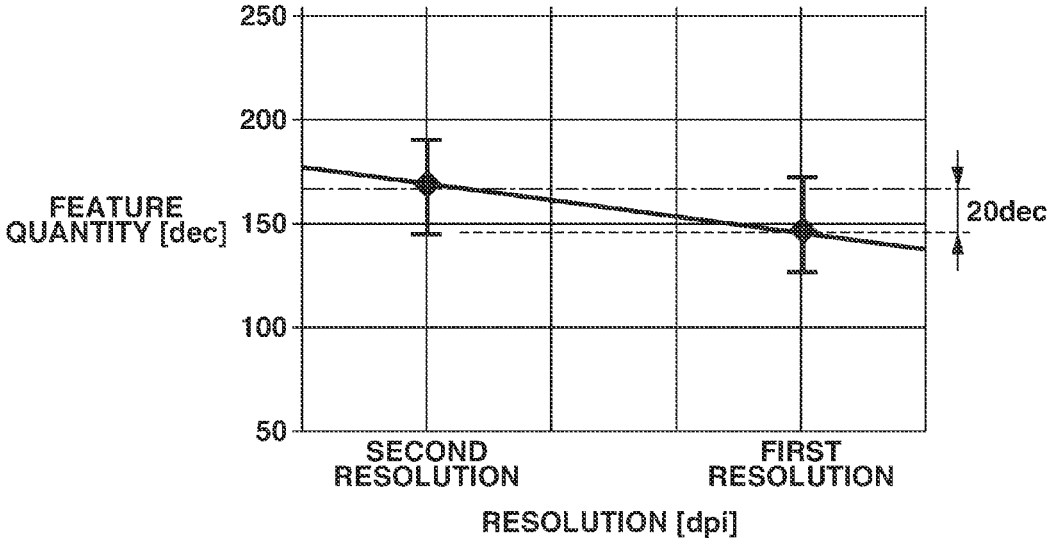
FIGS. 3A and 3B are graphs illustrating feature quantities acquired by the surface property detection unit.
Figure 3B:
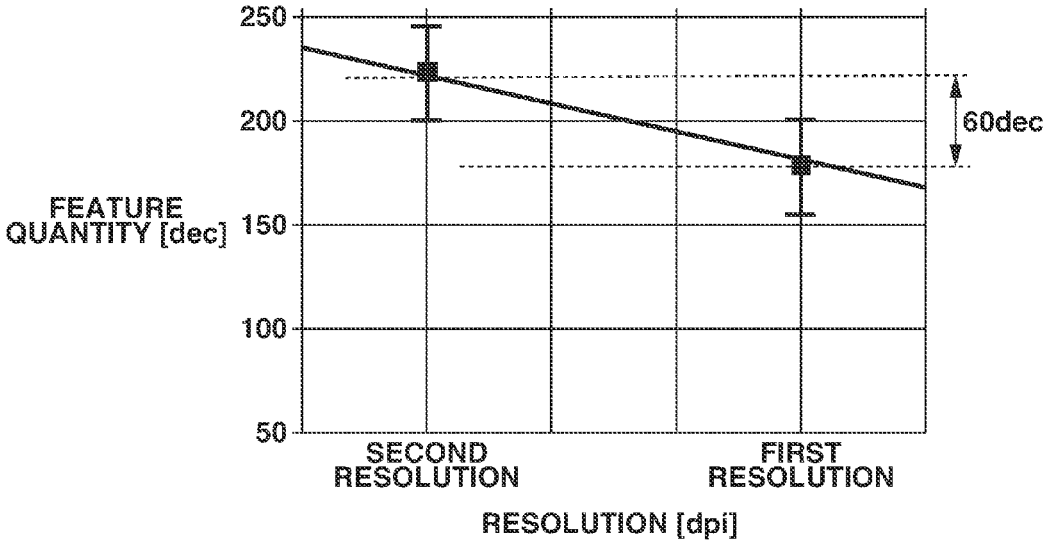

Next, a method for determining a type of the recording sheet P based on a detection result of the surface property detection unit 32 will be described. In the present exemplary embodiment, determination of a plain paper and a bond paper will be considered. FIGS. 3A and 3B are graphs illustrating feature quantities calculated by the control unit 10 when the surface property detection unit 32 detects the plain paper and the bond paper. FIG. 3A illustrates a calculation result of the plain paper, whereas FIG. 3B illustrates a calculation result of the bond paper.

First, a method for determining the plain paper or the bond paper based on one image having a predetermined resolution will be considered. Attention is focused on the feature quantities of a first resolution illustrated in FIGS. 3A and 3B. Herein, 600 dpi is employed as the first resolution. The feature quantity of the plain paper and the feature quantity of the bond paper are 150 dec and 170 dec, respectively. A difference between the feature quantities is 20 dec. Herein, it is known that the recording sheet P has variation in a surface property caused by a production machine or a production lot. Such variation also appears on a feature quantity, and thus the feature quantity varies by approximately ±20 dec from the average value thereof. Accordingly, for example, if the plain paper has a feature quantity with variation of the highest value whereas the bond paper has a feature quantity with variation of a lowest value, at is difficult to accurately determine the type of the recording sheet P.

Therefore, the type of the recording sheet P may not be determined accurately only with a single image having a predetermined resolution. Therefore, in the present exemplary embodiment, description will be given to a method for controlling the image forming condition by accurately determining a type of the recording sheet P using a plurality of images having different resolutions.

Description thereof will be given continuously with reference to FIGS. 3A and 3B. In each of FIGS. 3A and 3B, a feature quantity of a second resolution different from the first resolution is illustrated in addition to the feature quantity of the first resolution. Herein, 300 dpi is employed as the second resolution. The feature quantity of the plain paper and the feature quantity of the bond paper are 170 dec and 230 dec, respectively. A difference between the feature quantities is 60 dec, which is greater than in the case of the first resolution. In the present exemplary embodiment, attention is focused on a difference value between the feature quantities of the first and the second resolutions. As illustrated in FIGS. 3A and 3B, a difference value between the feature quantities in a case of the plain paper is 20 dec, which is less than a difference value 60 dec between the feature quantities of the bond paper. This is because a frequency property of the surface of the recording sheet P varies in sheet types. As described above, by using the images having different resolutions, a difference in the surface property caused by a difference in the frequency property can be acquired easily.

FIG. 4 is a table illustrating a relationship between the type of the recording sheet P and the difference value between the feature quantities. This table is stored in the ROM mounted on the control unit 10. As illustrated in FIG. 4, the sheet type can be accurately determined by setting a determination threshold value for determining the plain paper or the bond paper as 30 dec. Further, although the present exemplary embodiment will be described by using the two types of sheets, determination among three or more types of sheets can be executed by using a plurality of determination tables each similar to the table illustrated in FIG. 4.

Next, a method for capturing a plurality of images having different resolutions will be described. In the present exemplary embodiment, a storage time of the electric charge of the photodiode 201 is changed when the image is captured by the image capturing unit 32*c* while the recording sheet P is being conveyed. With this operation, a plurality of images having different resolutions in the sub-scanning direction can be captured. A relationship between the storage time of the electric charge, the resolution of the image, and the conveyance speed of the recording sheet. P is expressed by the following formula 1. In the formula 1, 1-inch is equal to 25.4 mm.

$$\text{Storage Time(sec)}=(25.4\ (\text{mm})/\text{Resolution(dpi)})/\text{Conveyance Speed(mm/sec)} \qquad \text{Formula 1}$$

In the present exemplary embodiment, the storage time is uniquely determined according to the resolution because the conveyance speed of the recording sheet P is constant. A storage time 1 corresponding to the first resolution and a storage time 2 corresponding to the second resolution can be acquired by the formula 1.

Next, a detection width of the recording sheet P detected by the surface property detection unit 32 will be described. In the present exemplary embodiment, detection of the recording sheet P at the first and the second resolutions is executed by setting a detection width to 10 mm in the sub-scanning direction. A relationship between the number of image-capturing times of the image capturing unit 32*c*, the detection range of the recording sheet P, and the resolution of the image is expressed by the following formula 2.

$$\text{Number of Image-Capturing Times (time)}=10\ \text{mm}/(25.4\ (\text{mm})/\text{Resolution (dpi)}) \qquad \text{Formula 2}$$

A number of image-capturing times 1 corresponding to the first resolution and a number of image-capturing times 2 corresponding to the second resolution can be acquired by the formula 2. In the present exemplary embodiment, although the detection width of the recording sheet P is set to 10 mm, the detection width can be set as appropriate according to a required detection accuracy or a measurement time.

Figure 5:
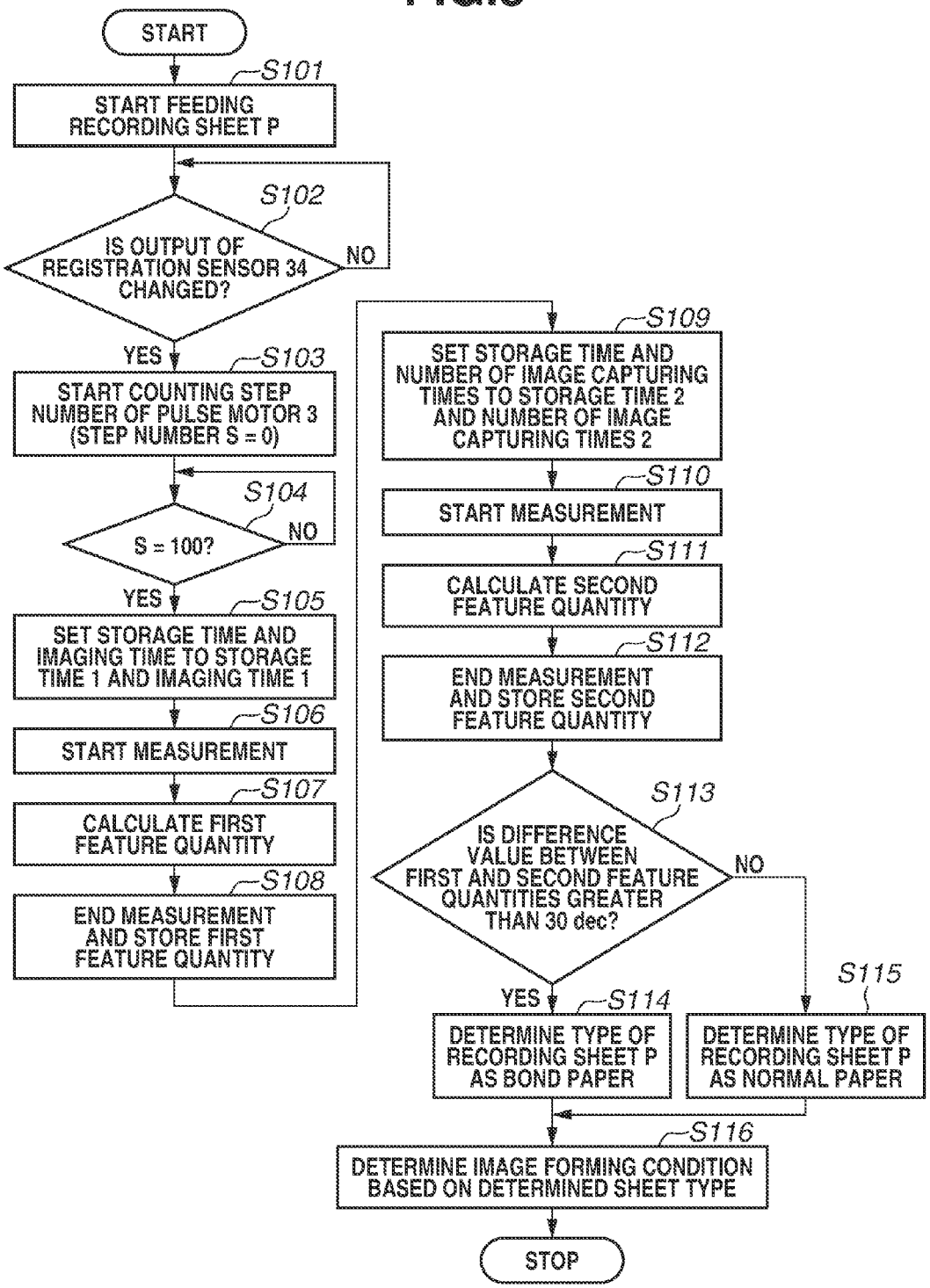
FIG. 5 is a flowchart illustrating processing for controlling an image forming condition according to the first exemplary embodiment.

Subsequently, a processing sequence for detecting a surface property of the recording sheet P according to the present exemplary embodiment will be described with reference to a flowchart in FIG. 5. The control based on the flowchart in FIG. 5 is executed by the control unit 10 based on a program stored in the ROM (not illustrated). However, not all of the processing steps illustrated in the flowchart have to be executed by the control unit 10. If the printer 1 is provided with an application specific integrated circuit (ASIC), for example, the ASIC may have a function for executing any of the processing steps illustrated in the flowchart.

In step S101, the control unit 10 receives a printing instruction from an external device (not illustrated) such as a personal computer (PC) and starts sheet feeding and image forming operations. The control unit 10 controls the feeding roller 4 to feed the recording sheet P to the conveyance path from the cassette 2. The control unit 10 controls the conveyance roller pair 5 and the registration roller pair 6 to convey the fed recording sheet P. In step S102, when an output of the registration sensor 34 is changed at a timing at which a leading end of the recording sheet P passes through the registration roller pair 6 (YES in step S102), the processing proceeds to step S103. In step S103, the control unit 10 starts counting a step number S of the pulse motor 3 at the timing at which the output is changed as a starting point.

Hereinafter, a method for monitoring an arrival position. of the recording sheet P will be described. In the present exemplary embodiment, the recording sheet P is conveyed by the pulse motor 3 at a conveyance speed of 100 mm/sec. The arrival position of the recording sheet P is monitored by using the registration sensor 34, the pulse motor 3, and the control unit 10. Because the step number S of the pulse motor 3 and a rotation distance are in a proportional relationship, a distance by which the recording sheet P has moved after passing the registration roller pair 6 can be estimated from the counted number of steps.

In the present exemplary embodiment, a position at which the leading end of the recording sheet P has reached the registration sensor 34 is taken as a reference, and a number of steps necessary for the recording sheet P to reach the surface property detection unit 32 is assumed as 100 steps. However, this "100 steps" is merely an example, and the step number S is calculated based on the pulse motor 3 and the diameters of the registration roller pair 6 to be used. Although the method for monitoring the position. of the recording sheet P has been described by using the pulse motor 3, the monitoring method is not limited to the above, and any method can be employed as long as the control unit 10 can determine whether the recording sheet P has reached the surface property detection unit 32. Therefore, it is possible to employ a method using time management, e.g., starting the measurement after a predetermined time has passed from the change in the output of the registration sensor 34, or starting the measurement after a predetermined time has passed from a timing of starting the motor rotation control.

In step S104, when 100 steps are counted from a timing at which the output of the registration sensor 34 has changed, the control unit 10 determines that the leading end of the recording sheet P has reached the surface property detection unit 32. Herein, when the leading end of the recording sheet P has reached the surface property detection unit 32, the conveyance speed of the recording sheet P is controlled to be a target value 100 mm/sec of the present exemplary embodiment.

If the control unit 10 determines that the recording sheet P has reached the surface property detection unit 32 (YES in step S104), the processing proceeds to step S105. in step S105, the control unit 10 sets the storage time and the number of image-capturing times of the surface property detection unit 32 to a storage time 1 and a number of image-capturing times 1, respectively. In step S106, the surface property detection unit 32 starts measurement, and in step S107, the control unit 10 calculates a first feature quantity. In step S108, the surface property detection unit 32 ends the measurement, and the control unit 10 stores the first feature quantity in the RAM. Next, in step S109, the control unit 10 sets the storage time and the number of image-capturing times of the surface property detection unit 32 to a storage time 2 and a number of image-capturing times 2, respectively. In step S110, the surface property detection unit 32 starts measurement, and in step S111, the control unit calculates a second feature quantity. In step S112, the surface property detection unit 32 ends the measurement, and the control unit 10 stores the second feature quantity in the RAM.

Next, in step S113, the control unit 10 calculates a difference value between the first and the second feature quantities, and compares the difference value to the determination threshold value 30 dec. If the control unit 10 determines that the difference value is greater than the determination threshold value 30 dec (YES in step S113), the processing proceeds to step S114. In step S114, the control unit 10 determines that the type of the recording sheet P is a bond paper. On the other hand, if the control unit 10 determines that the difference value is equal to or less than the determination threshold value 30 dec (NO in step S113), the processing proceeds to step S115. In step S115, the control unit 10 determines that a type of the recording sheet P is a plain paper. Then, in step S116, the control unit 10 determines the image forming condition based on the determined type of the recording sheet P.

As described above, according to the present exemplary embodiment, by capturing a plurality of images having different resolutions, the type of the recording material can be determined accurately and an image of high quality can be formed.

As illustrated in FIG. 5, in the present exemplary embodiment, the surface property detection unit 32 captures two images having different resolutions before the control unit 10 determines the type of the recording sheet P. However, the configuration is not limited to the above. For example, after one image having the first resolution is captured by the surface property detection unit 32, the control unit may determine the type of the recording sheet P based on the feature quantity acquired from the one image. Then, in a case where the control unit 10 cannot uniquely determine the type of the recording sheet P, another image having the second resolution may be additionally captured by the surface property detection unit 32. In this case, the control unit 10 may control the image forming condition by simply determining the type of the recording sheet P based on the feature quantity acquired from the image having the second resolution without calculating the difference value of the two feature quantities.

Further, in the present exemplary embodiment, in order to capture a plurality of images having different resolutions, the storage time of the electric charge of the photodiode 201 is changed. However, the configuration is not limited thereto. A plurality of images having different resolutions in the sub-scanning direction can be captured by changing the conveyance speed of the recording sheet P in the image-capturing period. As described above, a relationship between the storage time of the electric charge, the resolution of the image, and the conveyance speed of the recording sheet P can be expressed by the formula 1, and the formula 1 can be converted into the following formula 3.

$$\text{Conveyance Speed (mm/sec)} = (25.4\ \text{(mm)}/\text{Resolution (dpi)})/\text{Storage Time(sec)} \qquad \text{Formula 3}$$

Herein, if the storage time of the electric charge is set to be constant, the conveyance speed is uniquely determined according to the resolution. A conveyance speed 1 corresponding to the first resolution and a conveyance speed 2 corresponding to the second resolution can be respectively acquired by the formula 3. Then, by setting the conveyance speed instead of the storage time in steps S105 and S109 of the flowchart in FIG. 5, the control unit 10 can execute similar control processing. Although the conveyance speed of the recording sheet P is set to be constant when the storage time of the electric charge is changed, and the storage time of the electric charges is set to be constant when the conveyance speed of the recording sheet P is changed in the present exemplary embodiment, the configuration is not limited to the above. A plurality of images having different resolutions may be captured by changing both of the storage time and the conveyance speed.

Figure 12:
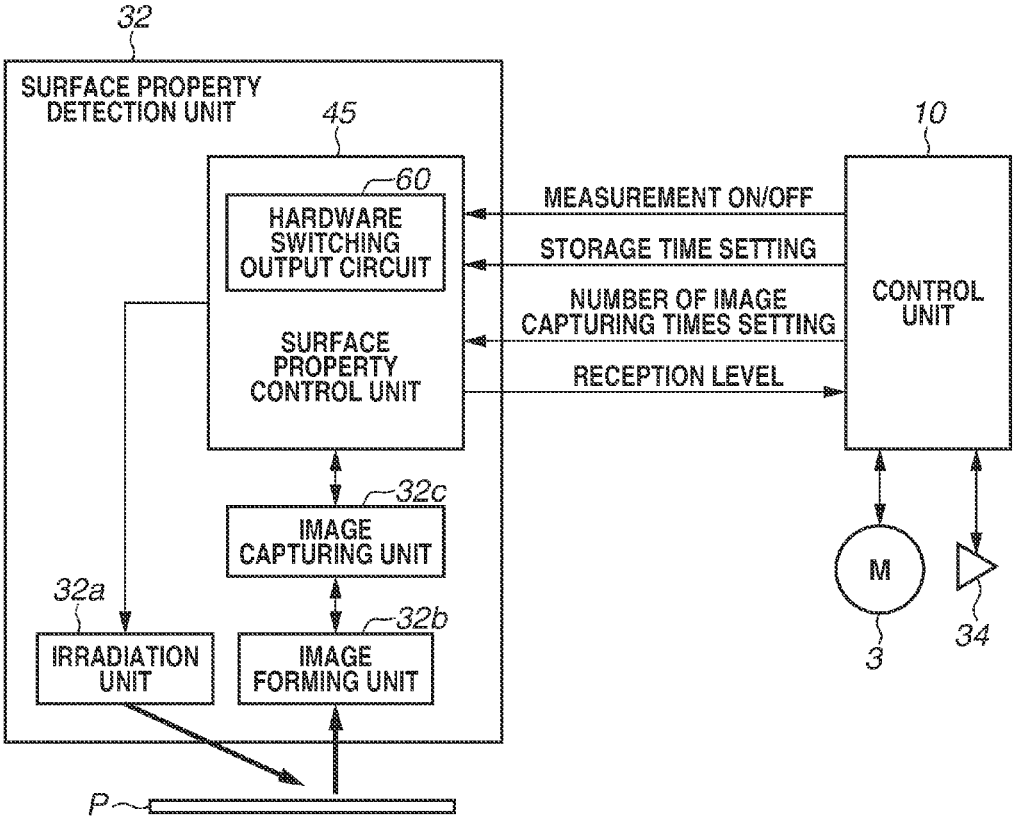
FIG. 12 is a block diagram illustrating a surface property detection unit including a hardware switching output circuit.

Further, although the resolution in the sub-scanning direction is changed in the present exemplary embodiment, the same effect can be achieved by changing the resolution in the main scanning direction. For example, in order to change the resolution in the main scanning direction, a hardware switching output circuit 60 (illustrated in FIG. 12) for adding or thinning out the output values of respective light receiving elements may be attached to the image capturing unit 32*c* or the surface property control unit 45. Then, the image having the first resolution is acquired by using the output value of one light receiving element as the output value of one pixel. Further, the image of the second resolution can be acquired by adding the output values of two light receiving elements consecutively arranged in the main scanning direction and using the added value as the output value of one pixel.

Further, in the above-described method using the hardware switching output circuit 60, the resolution in the sub-scanning direction may be changed or both of the resolutions in the sub-scanning direction and the main scanning direction may be changed. At this time, the resolutions in the sub-scanning direction and the main scanning direction may be changed separately or simultaneously. With the use of the hardware switching output circuit 60, the control unit 10 can acquire the feature quantities of two images having different resolutions when the image capturing unit 32*c* only captures one image.

Hereinafter, a second exemplary embodiment will be described. In the first exemplary embodiment, the feature quantities of a plurality of surface images having different resolutions are acquired through the hardware control of the surface property detection unit 32. In the present exemplary embodiment, description will be given to a method for acquiring the feature quantities of a plurality of surface images having different resolutions through software control. The present exemplary embodiment is mainly similar to the first exemplary embodiment, and thus only configurations different from the first exemplary embodiment will be described.

Figure 6A:
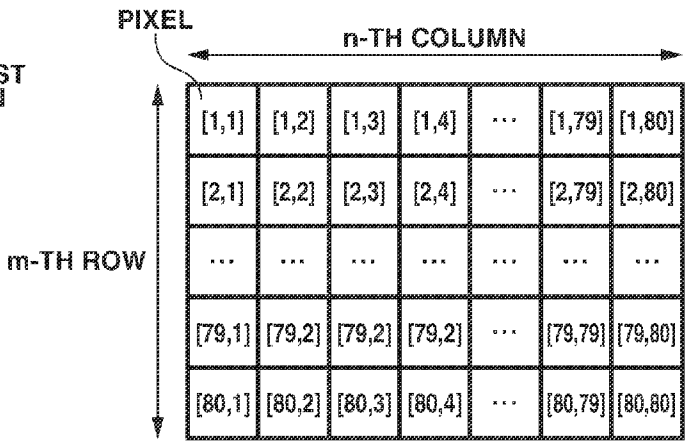
FIGS. 6A and 6B are diagrams illustrating images having different resolutions according to the second exemplary embodiment.

The present exemplary embodiment will be described by using a CMOS area sensor as the image capturing unit 32*c*. The light receiving elements of the image capturing unit 32*c* are arranged in a matrix state of 80 pieces in the main scanning direction and 80 pieces in the sub-scanning direction. Herein, one light receiving element corresponds to one pixel. FIG. 6A is a diagram illustrating one image captured by the CMOS area sensor. In FIG. 6A, a letter "m" represents a pixel position in the sub-scanning direction, whereas a letter "n" represents a pixel position in the main scanning direction. Although the present exemplary embodiment will be described by using the CMOS area sensor, the CMOS line sensor described in the first exemplary embodiment may be also used.

<Description of Determination Method of Type of Recording Material>

Next, description will be given to a method in which the control unit 10 executes software processing to acquire feature quantities of two images having different resolutions from reception levels (output values) of pixels output from the surface property control unit 45. Based on the reception levels of the pixels arranged in 80×80 as illustrated in FIG. 6A, the control unit 10 acquires the first feature quantity of the image having the first resolution through the method (i.e., vertical difference integration) described in the first exemplary embodiment. Next, in order to acquire the second feature quantity of the image having the second resolution, the control unit 10 firstly adds the reception levels of four pixels as one based on the following formula 4. Herein, a reception level 1(m, n) represents a reception level of a pixel in an m-th row and an n-th column of the image having the first resolution. Then, a reception level 2(m, n) represents a reception level of a pixel in an m-th row and an n-th column of the image having the second resolution.

$$\text{Reception Level } 2(m, n) = \text{Reception Level } 1(m\times 2-1, n\times 2-1) + \text{Reception Level } 1(m\times 2-1, n\times 2-1+1) + \text{Reception Level } 1(m\times 2-1+1, n\times 2-1) + \text{Reception Level } 1(m\times 2-1+1, n\times 2-1+1) \quad \text{Formula 4}$$

Figure 6B:
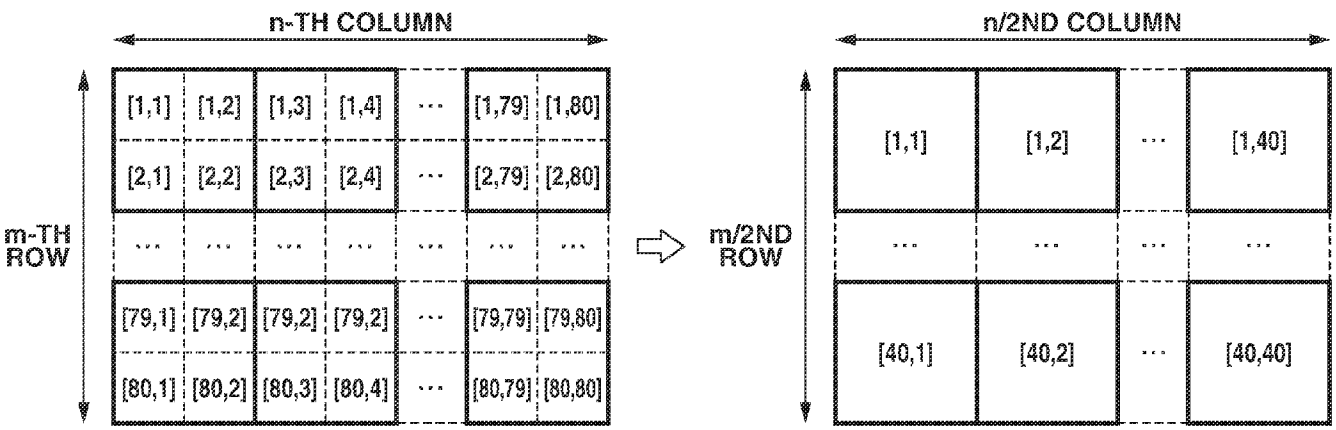

FIG. 6B is a diagram illustrating an image having the second resolution acquired by the software processing. The control unit 10 acquires the second feature quantity based on the reception levels of respective pixels (40×40 pixels).

Figure 7:
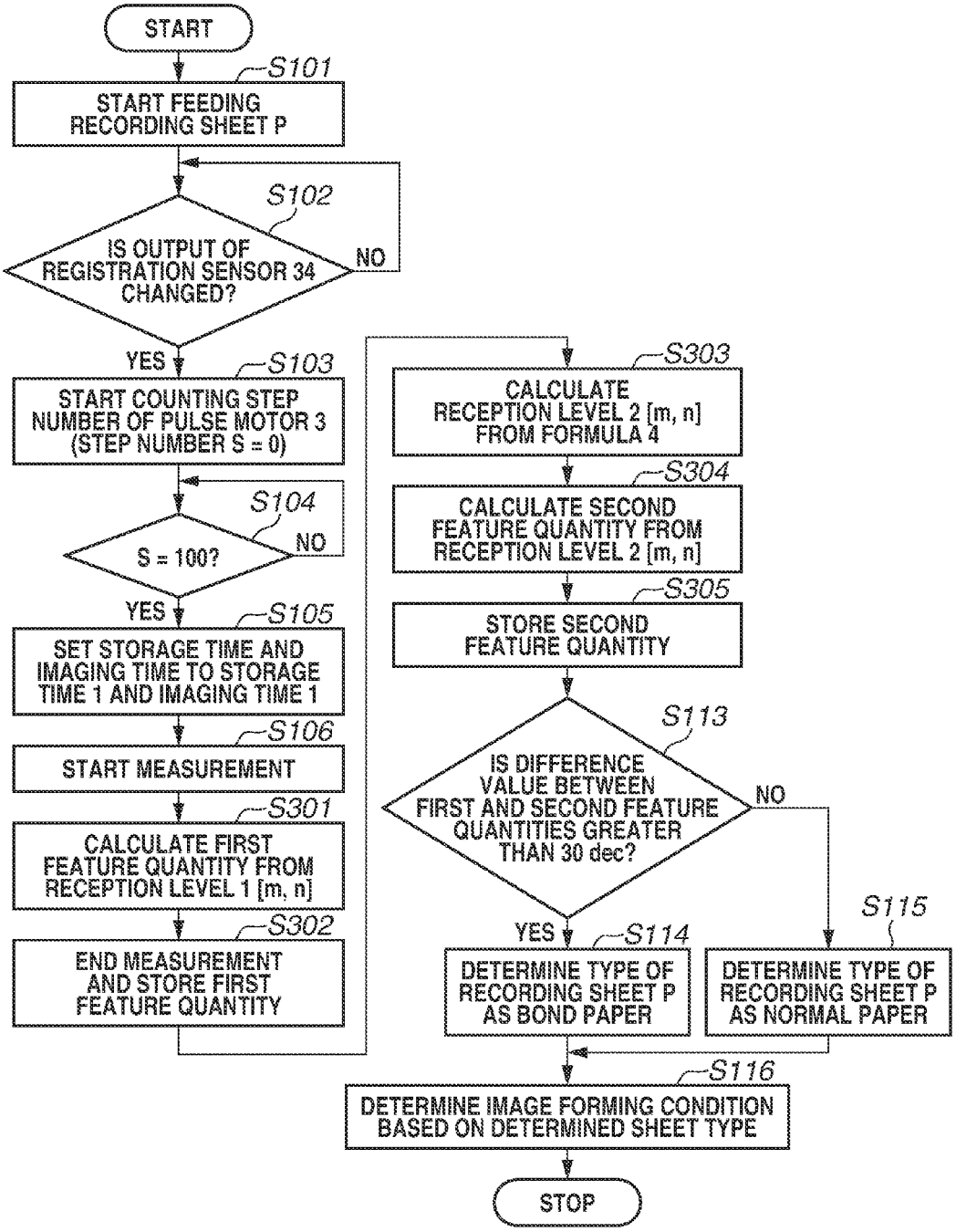
FIG. 7 is a flowchart illustrating processing for controlling an image forming condition according to the second exemplary embodiment.

Subsequently, a processing sequence for detecting a surface property of the recording sheet P according to the present exemplary embodiment will be described with reference to a flowchart in FIG. 7. The control based on the flowchart in FIG. 7 is executed by the control unit 10 based on a program stored in the ROM (not illustrated). The processing will be described while applying the same reference numerals to the processing steps common to the flowchart in FIG. 5.

In the flowchart in FIG. 7, the processing in steps S101 to S106 and steps S113 to S116 is similar to the processing described in the first exemplary embodiment, and thus description thereof will be omitted. In step S301, the control unit 10 calculates the first feature quantity from the image having the first resolution captured by the image capturing unit 32*c*. In step S302, the surface property detection unit 32 ends the measurement, and the control unit 10 stores the first feature quantity in the RAM. Then in step S303, the control unit 10 calculates the reception level 2(m, n) by using the formula 4. In other words, the control unit 10 calculates the image having the second resolution. In step S304, the control unit 10 calculates the second feature quantity from the image having the second resolution. In step S305, the control unit 10 stores the second feature quantity in the RAM.

As described, above, according to the present exemplary embodiment, the configuration thereof can be simplified as it is not necessary to execute the hardware control such as switching the storage time setting of the image capturing unit 32*c* as in the first exemplary embodiment. Further, a detection time can be shortened because the image capturing unit 32*c* does not have to capture images for a plurality of times.

Further, although the reception levels of four pixels are added as one in the present exemplary embodiment, any number of reception levels can be added as long as the image can be converted. into an image having a resolution. different from the first resolution. Furthermore, although the resolution is changed by adding the output values of four pixels, another method such as adding only the output values of pixels in the sub-scanning direction or the main scanning direction or thinning out the output values of the pixels instead of adding may be employed.

Hereinafter, a third exemplary embodiment will be described. In the first and the second exemplary embodiments, the detection unit 30 is configured of the surface property detection unit 32. In the present exemplary embodiment, description will be given to a configuration in which the detection unit 30 further includes a grammage detection unit 31 for detecting a grammage of the recording sheet P. By using respective detection results acquired by the grammage detection unit 31 and the surface property detection unit 32, the type of the recording sheet P can be determined with higher accuracy. The present exemplary embodiment is mainly similar to the first exemplary embodiment, and thus only configurations different from the first exemplary embodiment will be described.

<Description of Image Forming Apparatus and Recording Material Determination Unit>

Figure 8:
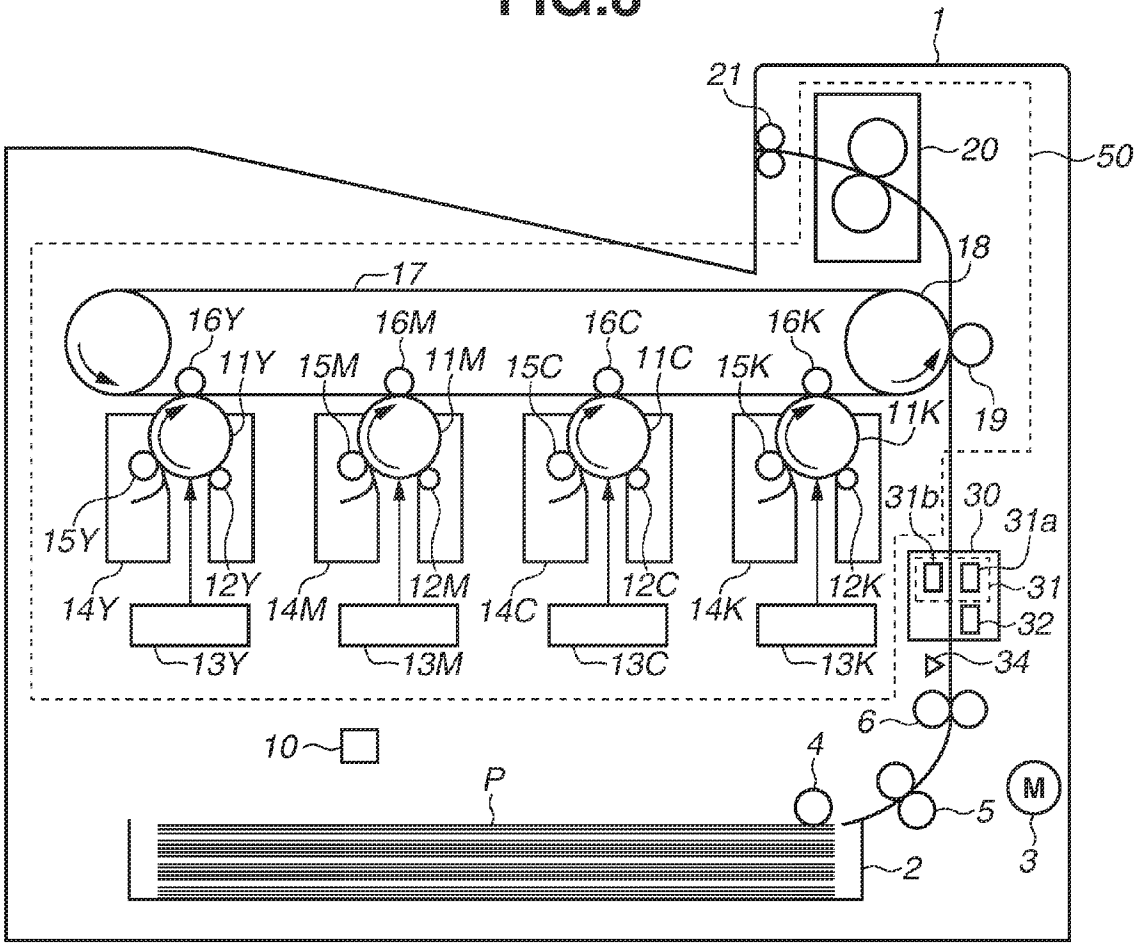
FIG. 8 is a diagram illustrating a configuration of an image forming apparatus according to a third exemplary embodiment.

Configurations of the printer 1 and the detection unit 30 according to the present exemplary embodiment will be described. FIG. 8 is a diagram schematically illustrating a configuration of the printer 1 according to the present exemplary embodiment. The configuration is different from the configuration illustrated in FIG. 1 in that the detection unit 30 includes the grammage detection unit 31. The grammage detection unit 31 is configured of an ultrasonic wave transmission unit 31*a* (transmission unit) for transmitting an ultrasonic wave to the recording sheet P and an ultrasonic wave reception unit 31*b* (reception unit) for receiving the ultrasonic wave attenuated through the recording sheet. P.

Figure 9:
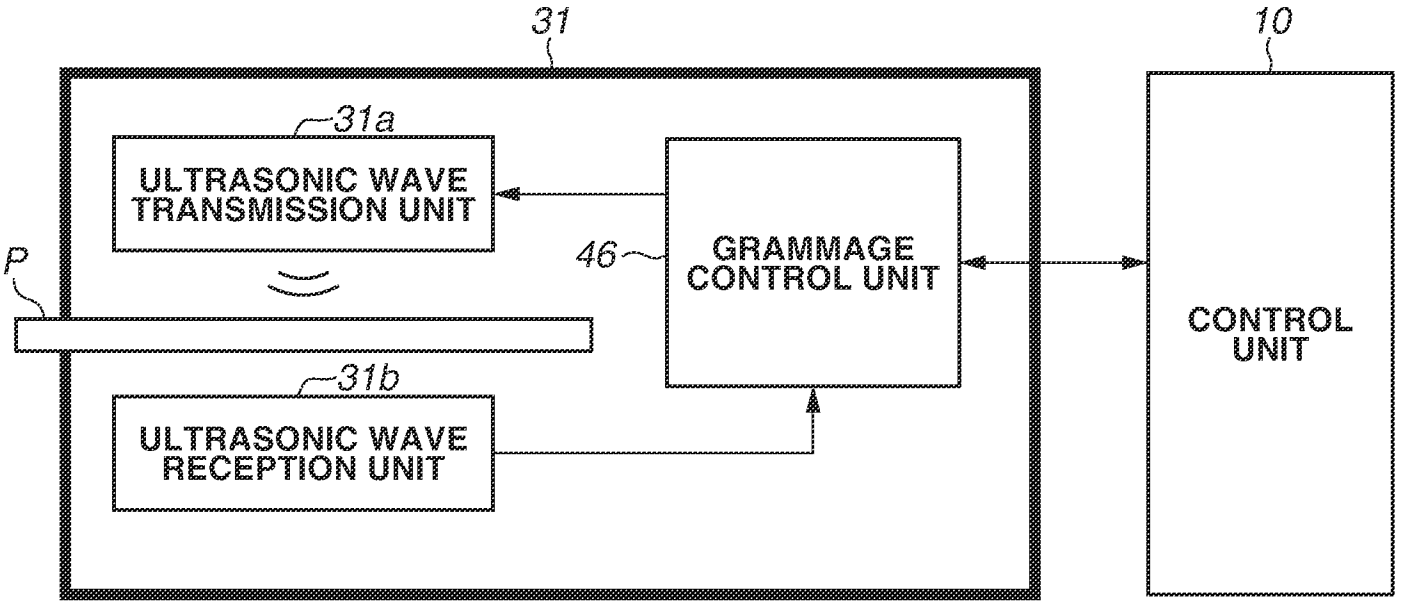
FIG. 9 is a block diagram illustrating a grammage detection unit.

FIG. 9 is a block diagram of the grammage detection unit 31 which constitutes the detection unit 30. The ultrasonic wave transmission unit 31*a* and the ultrasonic wave reception unit 31*b* are disposed opposite to each other in such a manner that the recording sheet P is conveyed therebetween. The ultrasonic wave transmission unit 31*a* and the ultrasonic wave reception unit 31*b* are connected to the grammage control unit 46. The ultrasonic wave transmission unit 31*a* transmits an ultrasonic wave of a predetermined frequency according to an instruction of the grammage control unit 46. The ultrasonic wave reception unit 31*b* receives the ultrasonic wave having passed through the recording sheet P and outputs a voltage value according to the received ultrasonic wave. The grammage control unit 46 outputs a peak value of the voltage value output from the ultrasonic wave receiving unit 31*b* to the control unit 10.

<Description of Determination Method of Type of Recording Material>

In the present exemplary embodiment, a type of the recording sheet P is determined more accurately by acquiring plurality of images having different resolutions through the method described in the first or the second exemplary embodiment and by further using a result acquired by the grammage detection unit 31. In the present exemplary embodiment, determination of a sheet type is executed with respect to a thin paper and a thin bond paper each having a grammage of less than 70 g/m$^2$, and a plain paper and a bond paper each having a grammage of 70 g/m$^2$ or more FIG. 10 is a determination table of types of recording sheets P according to the present exemplary embodiment. As illustrated in FIG. 10, a threshold value of a difference value between the feature quantities for determining the thin paper and the thin bond paper is 20 dec, which is different from a threshold value 30 dec of a difference value between the feature quantities for determining the plain paper and the bond paper. As described above, the threshold value for determining the type of the recording sheet P in more detail is changed according to a range of the grammage. With this configuration, the recording sheets P of various types can be determined regardless of the grammages thereof.

Although the threshold value of a difference value between the feature quantities is changed according to a range of the grammage in the present exemplary embodiment, determination of the sheet type may be executed by correcting the difference value between the feature quantities according to a range of the grammage. For example, if the grammage detection unit 31 has detected that the grammage of the recording sheet P is less than 70 g/m$^2$, a difference value between the feature quantities is corrected by +10 dec. With this operation, the type of the recording sheet P can be determined by using the threshold value 30 dec of the recording sheet P having the grammage of 70 g/m$^2$ or more. The grammage of the recording sheet P used in the present exemplary embodiment is merely an example, and the threshold value can be set as appropriate according to the type of the recording sheet P to be determined.

Figure 11:
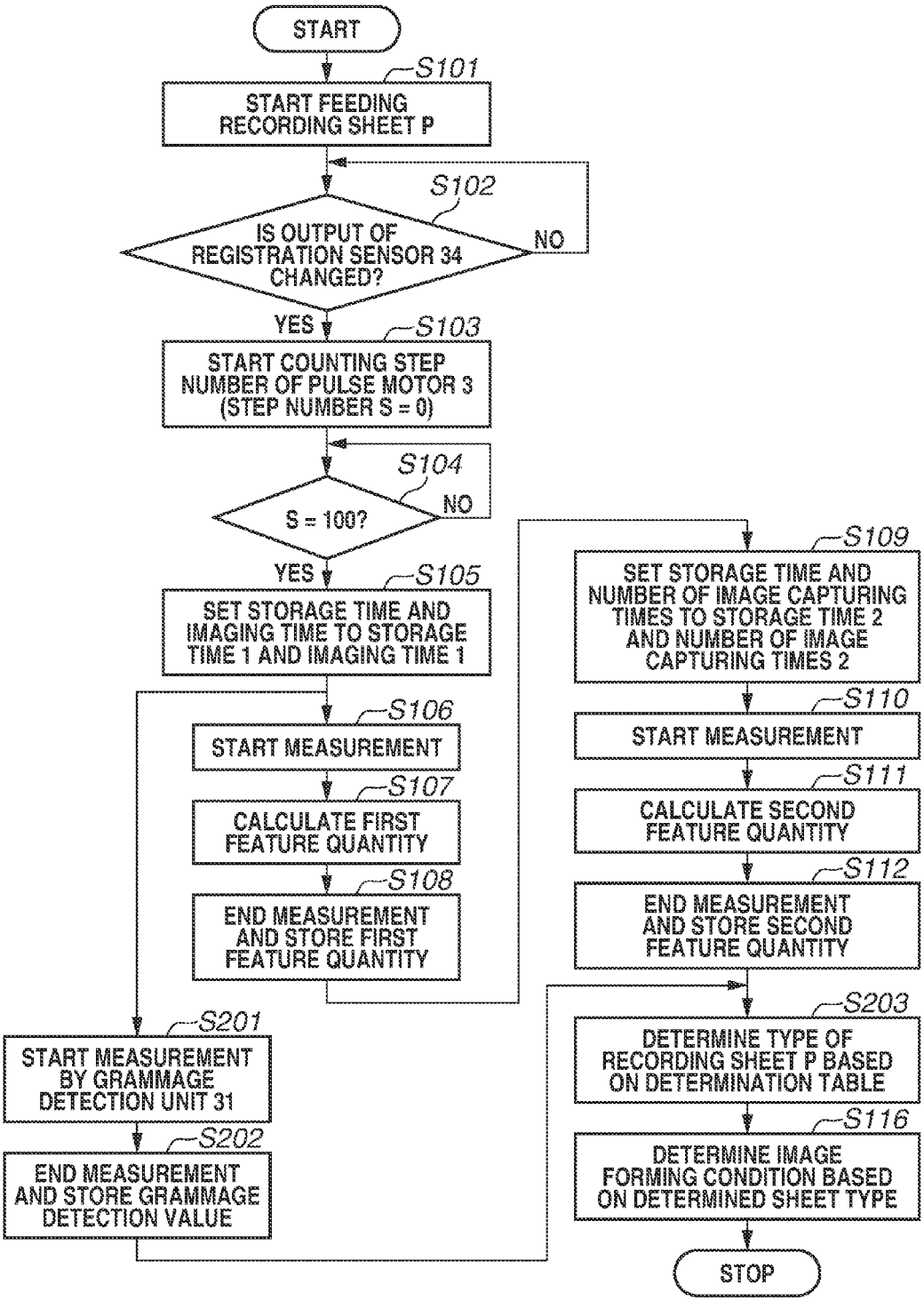
FIG. 11 is a flowchart illustrating processing for controlling an image forming condition according to the third exemplary embodiment.

Subsequently, a processing sequence for detecting a surface property of the recording sheet P according to the present exemplary embodiment will be described with reference to a flowchart in FIG. 11. The control based on the flowchart in FIG. 11 is executed by the control unit 10 based on a program stored in the ROM (not illustrated). The processing will be described while applying the same reference numerals to the processing steps common to the flowchart in FIG. 5.

In the flowchart in FIG. 11, the processing in steps S101 to S112 is similar to the processing described in the first exemplary embodiment, and thus description thereof will be omitted. In step S201, in parallel with the measurement executed by the surface property detection unit 32 in steps S106 to S112, the control unit 10 controls the grammage detection unit 31 to start measurement. Then, in step S202, the grammage detection unit 31 ends the measurement, and the control unit 10 stores a detection result of the grammage detection unit 31 in the RAM. In step S203, the control unit 10 determines a type of the recording sheet P based on the determination table illustrated in FIG. 10. Then, in step S116, the control unit 10 determines the image forming condition based on the determined type of the recording sheet P.

As described above, according to the present exemplary embodiment, the following effect can be acquired in addition to the effects described in the first and the second exemplary embodiments. In other words, the sheet type can be determined more in detail by using a detection result of the grammage of the recording sheet P in addition to the feature quantities acquired from a plurality of images having different resolutions. With this configuration, suitable image forming conditions can be set according to various types of recording sheets P having different grammages, and thus the image quality can be improved.

Further, according to the present exemplary embodiment, description is given to a configuration in which the grammage detection unit 31 for detecting the grammage of the recording sheet P is provided on the detection unit 30. However, the configuration not limited to the above. For example, a sensor for detecting a thickness of the recording sheet P may be provided. A sensor which detects a thickness of the recording sheet P from an amount of received light by emitting light to the recording sheet P and receiving the light having passed through the recording sheet P may be used as a sensor for detecting the thickness. The sensor outputs a voltage value according to the amount of received light. Then, the control unit 10 may control the image forming condition by determining the type of the recording P based on the feature quantities of the plurality of images having the resolutions different from the voltage value output by the sensor.

According to the above-described present exemplary embodiment, the control unit 10 controls the image forming condition by determining the type of the recording sheet P based on the plurality of images having different resolutions. Then, the control unit 10 simply executes four arithmetic operations of the feature quantities acquired from the plurality of images having different resolutions. Therefore, it is not necessary to execute a complex arithmetic operation for converting image data into frequency component data through the Fourier transformation. Accordingly, the type of the recording sheet P and the image forming condition can be determined without increasing the cost.

In the above-described exemplary embodiment, although the image capturing unit 32*c* is described by using the CMOS line sensor, the configuration is not limited to the above. Any sensor that can adjust the storage time of electric charges, such as a charge coupled device (CCD) sensor, may be used therefor. Further, a size or a number of the light receiving elements can be set as appropriate according to a required detection accuracy or restriction in cost or the size. Furthermore, a CMOS area sensor in which light receiving elements are arranged in a plurality of rows may be used instead of the CMOS line sensor in which light receiving elements are arranged in a single row.

In the above-described exemplary embodiment, a resolution for calculating the difference value between the feature quantities can be set as appropriate according to a range or a detection accuracy of the resolution detectable by the surface property detection unit 32 or a sheet type to be determined. Although the type or the recording sheet P is determined by using the difference value between the feature quantities acquired from two images having different resolutions, the arithmetic method is not limited to the method using a difference. For example, a method using a proportion, an addition, a division, or a multiplication, or an arithmetic expression in which any of these arithmetic operations are combined may be used. Further, the measurement may be executed at three or more different resolutions instead of executing at the two different resolutions. In such a case, although the number of image-capturing times is increased, the accuracy for determining the type of the recording sheet P can be improved.

In the above-described exemplary embodiment, although the detection unit 30 is disposed on the printer 1 in a fixed manner, the detection unit 30 may be detachably attached to the printer 1. For example, if the detection unit 30 is detachably attached thereto, a user can easily replace the detection unit 30 when failure has occurred therein. Alternatively, the detection unit 30 may be additionally attachable to the printer 1 in a simple manner.

In the above-described exemplary embodiment, the detection unit 30 and the control unit 10 may be integrated into to a recording material determination apparatus and detachably attached to the printer 1. As described above, if the detection unit 30 and the control unit 10 can be replaced integrally, the user can easily replace the detection unit 30 with a detection unit having a new function when a function of the detection unit 30 is updated or added. Further, the detection unit 30 and the control unit 10 may be integrated, so as to be additionally attachable to the printer 1 in a simple manner.

Further, in the above-described exemplary embodiment, a laser beam printer is described as an example. However, the image forming apparatus to which the present disclosure is applied is not limited thereto, and thus the image forming apparatus may be a printer of another printing system such as an inkjet printer or may be a copying machine.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2015-214973, filed Oct. 30, 2015, which is hereby incorporated by reference herein in its entirety.

What is claimed is:

1. An image forming apparatus comprising:

an image formation unit configured to form an image on a recording material;

a conveyance unit configured to convey the recording material;

an irradiation unit configured to emit light onto the recording material being conveyed by the conveyance unit;

an image capturing unit configured to capture the light emitted by the irradiation unit and reflected from the recording material as a surface image of the recording material; and a control unit configured to control an image forming condition of the image formation unit based on the surface image of the recording material captured by the image capturing unit, wherein the image capturing unit captures a plurality of surface images of the recording material having different resolutions, and the control unit controls the image forming condition based on the plurality of surface images of the recording material having different resolutions.

2. The image forming apparatus according to claim 1, wherein the control unit controls the image capturing unit to capture the plurality of surface images of the recording material having different resolutions by changing a time for which the image capturing unit receives light and stores electric charges.

3. The image forming apparatus according to claim 1, wherein the control unit controls the image capturing unit to capture the plurality of surface images of the recording material having different resolutions by changing a speed of the recording material conveyed by the conveyance unit.

4. The image forming apparatus according to claim 1, wherein the control unit controls the image forming condition based on a difference between a first feature quantity acquired from the surface image of the recording material having a first resolution and a second feature quantity acquired from the surface image of the recording material having a second resolution.

5. The image forming apparatus according to claim 1 further comprising:

a transmission unit configured to transmit an ultrasonic wave; and a reception unit configured to receive the ultrasonic wave transmitted by the transmission unit and passing through the recording material, wherein the control unit controls the image forming condition based on the plurality of surface images of the recording material having different resolutions and the ultrasonic wave received by the reception unit.

6. The image forming apparatus according to claim 1, wherein the image capturing unit is a line sensor which includes a plurality of light receiving elements arranged in a direction that is parallel to a conveyance surface of a recording material and orthogonal to a conveyance direction of the recording material.

7. The image forming apparatus according to claim 1, wherein the image forming condition is a conveyance speed of a recording material, a value of voltage applied to a transfer unit included in the image formation unit, or a temperature at which a fixing unit included in the image formation unit fixes an image on the recording material.

8. A recording material determination apparatus comprising:

an irradiation unit configured to emit light onto a recording material being conveyed by a conveyance unit;

an image capturing unit configured to capture the light emitted by the irradiation unit and reflected from the recording material as a surface image of the recording material; and a control unit configured to determine a type of the recording material based on the surface image of the recording material captured by the image capturing unit, wherein the image capturing unit captures a plurality of surface images of the recording material having different resolutions, and the control unit determines the type of the recording material based on the plurality of surface images of the recording material having different resolutions.

9. The recording material determination apparatus according to claim 8 further comprising:

a transmission unit configured to transmit an ultrasonic wave; and a reception unit configured to receive the ultrasonic wave transmitted by the transmission unit and passing through the recording material, wherein the control unit determines a type of the recording material based on the plurality of surface images of the recording material having different resolutions and the ultrasonic wave received by the reception unit.

10. The recording material determination apparatus according to claim 8, wherein the control unit determines a surface property of the recording material based on the plurality of surface images of the recording material having different resolutions.

11. The recording material determination apparatus according to claim 9, wherein the control unit determines a grammage (alternatively a "thickness") of the recording material based on the ultrasonic wave received by the reception unit.

* * * * *